United States Patent [19]

Goguen

[11] 4,385,959

[45] May 31, 1983

[54] SPLICING TAPE DISPENSER-APPLICATOR

[75] Inventor: Louis J. Goguen, Cocagne, Canada

[73] Assignee: King Instrument Corporation, Westboro, Mass.

[21] Appl. No.: 286,873

[22] Filed: Jul. 27, 1981

[51] Int. Cl.[3] ..... B31F 5/06; G03D 15/04

[52] U.S. Cl. ..... 156/506; 156/518; 156/520; 156/530; 242/58.1

[58] Field of Search ..... 156/505, 506, 518, 519, 156/520, 530, 157, 521; 242/58.1

[56] References Cited

U.S. PATENT DOCUMENTS

| | | | |
|---|---|---|---|
| 3,753,835 | 8/1973 | King | 156/506 |
| 3,797,770 | 3/1974 | Hosoda et al. | 156/506 |
| 3,873,401 | 3/1975 | Gustafson | 156/505 |
| 3,986,919 | 10/1976 | Andrews | 156/506 |
| 4,120,718 | 10/1978 | Hudalla | 156/518 |
| 4,190,483 | 2/1980 | Ryan et al. | 156/505 |

*Primary Examiner*—Michael G. Wityshyn
*Attorney, Agent, or Firm*—Schiller & Pandiscio

[57] ABSTRACT

The invention is an improvement of the splicing tape dispenser-applicator shown in U.S. Pat. No. 3,753,835 which is designed for applying adhesive-coated splicing tape and is particularly useful in a machine for splicing magnetic tapes and winding magnetic tapes into cassettes. The basic mechanism comprises a carriage that supports a supply spool of splicing tape, feeding means for pulling splicing tape off of the supply spool and advancing it along a predetermined path, means for reciprocating the carriage vertically toward and away from a splicing station, means for indexing the feeding means so as to advance a selected amount of splicing tape when the carriage is moving away from the splicing station, and tape cutting and applying means comprising a cutter for severing a piece from the leading end of the splicing tape and a plunger for pressing the severed piece of splicing tape against tapes to be spliced located at the splicing station. The improvement comprises a pair of stationary guide pins arranged so as to maintain the severed piece of tape aligned with the plunger while the plunger is moving to press the severed piece of tape against the tapes to be spliced.

17 Claims, 7 Drawing Figures

SPLICING TAPE DISPENSER-APPLICATOR

This invention relates to tape splicing apparatus and more particularly to apparatus for splicing two elongated webs, e.g., two magnetic tapes or two pieces of photographic film, by means of an adhesive-coated splicing tape. The invention is described hereinafter as it would be used in a machine for splicing and winding magnetic tape into a tape cassette.

THE PRIOR ART

Magnetic tape cassettes, e.g. of the type shown in U.S. Pat. Nos. 3,423,038 and 3,167,267, are customarily available commercially with blank or prerecorded magnetic tape. The typical magnetic cassette consists of a cassette case containing two rotatable spools or hubs, a leader attached to each spool or hub, and a predetermined length of magnetic tape having its ends spliced by an adhesive splicing tape to the two leaders. In the manufacture of such cassettes, the common practice is to start with an empty cassette consisting of the cassette case with the two hubs and a single length of leader tape having one end connected to one hub and the other end connected to the second hub. The first step in filling the cassette with blank or prerecorded tape is to cut the leader tape to form two discrete leaders. Then the magnetic tape to be wound into the cassette is spliced to one leader and the hub to which the one leader is connected is rotated to wind up a given length of magnetic tape. Thereafter the magnetic tape is cut and the trailing end of the given length of magnetic tape is spliced to the leader attached to the other hub. An alternative procedure is to start with only the two hubs connected by a length of leader tape, sever the leader tape into two parts, splice magnetic tape to the leader on one hub, wind a given amount of magnetic tape on the one hub, sever the magnetic tape, splice the trailing end of the magnetic tape to the leader on the other hub, and thereafter mount the two hubs in a cassette case. This alternative procedure is the one usually practiced in loading video tape cassettes.

U.S. Pat. No. 3,753,835, issued Aug. 21, 1973, discloses a splicing tape dispenser-applicator adapted to be used to splice two elongated webs such as two magnetic tapes or two pieces of photographic film by means of an elongated adhesive-coated splicing tape. The same patent discloses how the splicing tape dispenser-applicator is adapted for automatic operation in a machine for splicing and winding magnetic tape into tape cassettes.

The splicer apparatus disclosed in U.S. Pat. No. 3,753,835 uses a reciprocating plunger/cutter assembly to cut a piece of splicing tape and press it against the tapes to be spliced. That splicing mechanism has been found to be deficient in that after it has been in repeated use, occasionally the magnetic tape is damaged or the splice is unsatisfactory as a result of misalignment of the leading end of the splicing tape as it is fed into the channel in which the plunger/cutter assembly is located or after it is severed and the plunger is moving to press it against the tapes to be spliced. Moreover vacuum is required to be applied to the plunger so as to create a suction force to hold the severed splicing tape against the plunger. The vacuum must be turned off and on and a substantial cost is incurred in the manufacture of the plunger and in the provision of the mechanical and electronic controls essential to the vacuum feature of the plunger. A further problem with the splicing mechanism of U.S. Pat. No. 3,753,835 is that the cutter limits the effective size of the portion of the plunger which presses the splicing tape against the tapes to be spliced, with the result that a reliable splice is not always obtainable because of air bubbles between the splice due to the fact that a substantial portion of the severed piece of splicing tape is not properly pressed against the tapes to be spliced.

OBJECTS AND SUMMARY OF THE INVENTION

Accordingly the primary object of this invention is to improve upon the splicing tape dispenser-applicator disclosed by U.S. Pat. No. 3,753,835.

Another object of this invention is to provide an improved splicing tape dispensing mechanism of the type described above which is compact, fast acting, reliable in operation, and adapted to be made at relatively low cost.

A further object is to provide an improved splicing tape dispenser-applicator which is especially suitable for use in a machine for loading magnetic tape onto a hub or into a cassette and is capable of repetitively making a better splice without damage to the magnetic tape than the mechanism disclosed in U.S. Pat. No. 3,753,835.

A specific feature and object of this invention is to provide a splicer similar to the one shown in U.S. Pat. No. 3,753,835 which is characterized by a new and simpler plunger arrangement and provides reliable guiding of the splicing tape so that it is properly aligned with the pressure pad on the end of the plunger as the plunger is moved to cause the pressure pad to press the splicing tape against the tapes being spliced.

The foregoing and other objects hereinafter made obvious are achieved by providing a splicing tape dispenser-applicator comprising (1) a plunger which is not adapted to apply a suction force but is provided with two parallel through holes, and (2) a pair of parallel pins which extend through the holes in the plunger and are anchored so that they remain stationary as the plunger is reciprocated. The pins are spaced apart by an amount only slightly greater than the width of the splicing tape and extend far enough so that they guide the severed splicing tape through the full operating stroke of the plunger, whereby the splicing tape is kept properly aligned from the time it is severed to the time when it is pressed into contact with the tapes to be spliced. An additional pair of guide pins is preferably provided in a position to accurately guide the splicing tape in front of the plunger. Certain other novel features hereinafter described further improve the splicing operation.

Other features and many of the attendant advantages of the invention are set forth in or rendered obvious by the following detailed specification which is to be considered with the accompanying drawings.

THE DRAWINGS

Figure 1:
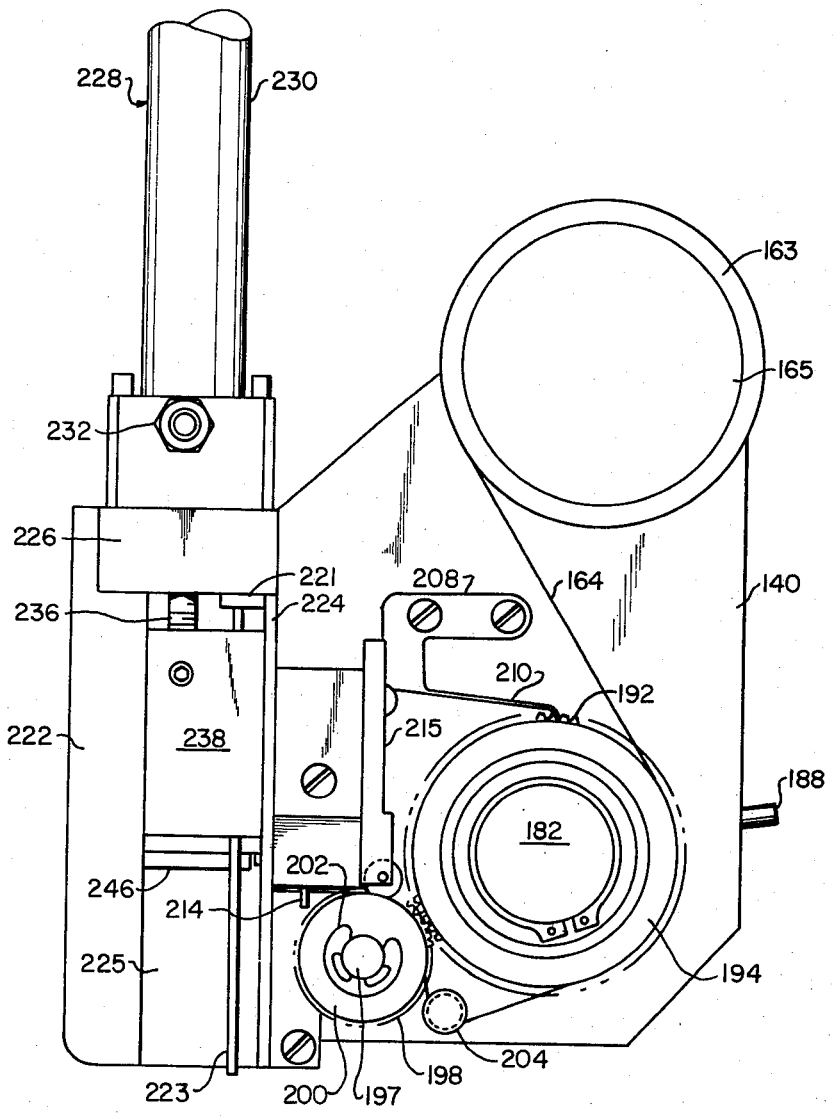
FIG. 1 is a front elevation of a splicing tape dispensing and applicating mechanism constructed in accordance with this invention.
Figure 2:
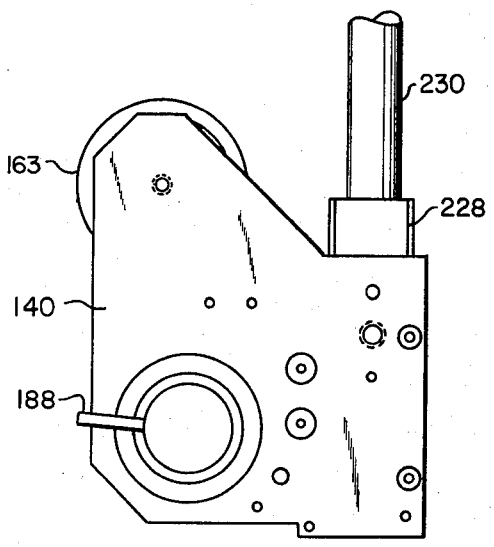
FIG. 2 is a rear elevation of the mechanism of FIG. 1.
Figure 5:
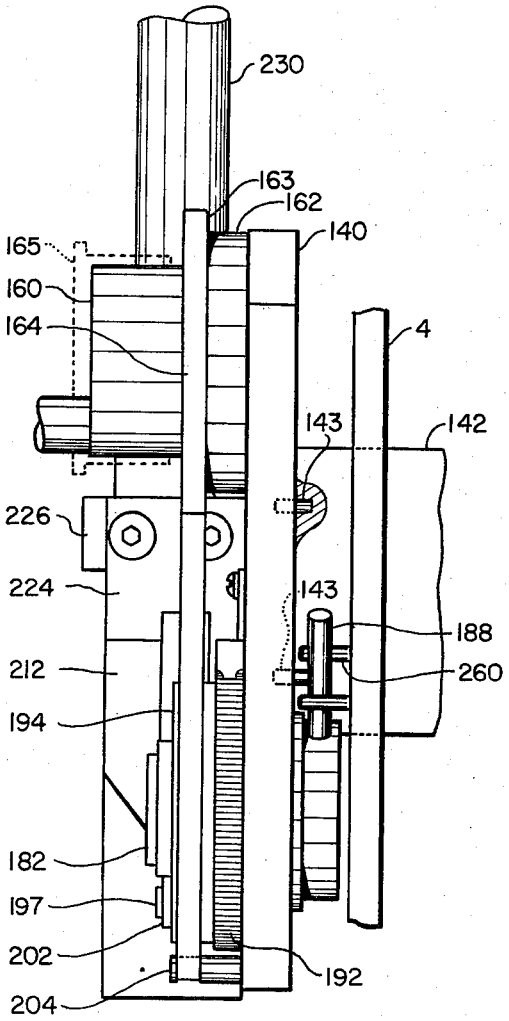
FIG. 5 is a side view, partly in section, showing how the splicing tape dispensing mechanism is mounted to a cassette tape winding and splicing machine.
Figure 6:
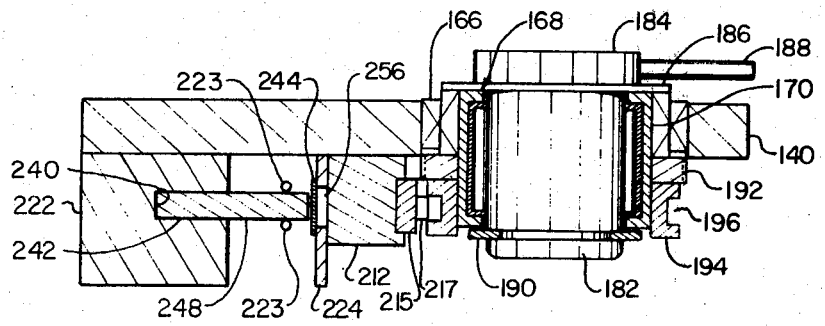
FIG. 6 is a sectional view taken along line 6—6 of FIG. 3.

Turning now to FIGS. 1, 5 and 6, the illustrated splicing tape dispensing mechanism 2 is designed for use with a tape splicing and winding machine of the type having a front panel 4 which supports a splicing head assembly 6 and the splicing tape dispensing mechanism 8. By way of example but not limitation, the tape splicing and winding machine may be a machine as shown in U.S. Pat. Nos. 3,737,358, 3,753,835, 3,997,123 and 4,061,286. Although not shown it is to be understood that such a machine further includes a rotatable supply reel shaft which projects through front panel 4 and supports a supply reel on which is wound a suppy of magnetic tape 10 that is to be used in filling cassettes, a cassette holder that is adapted to hold a cassette to be lowered, a rotatable winding spindle that projects out of front panel 4 and is adapted to mate with and drive one of the hubs of a cassette mounted in the cassette holder, a plurality of guide rollers including a roller 12 for guiding tape 10 as it is payed out from the supply reel to the splicing head assembly 6, and a guide roller 14 for the same tape as it moves from the splicing head assembly to a cassette mounted in the cassette holder. The supply reel shaft and the spindle are connected to and driven by suitable individual drive units, e.g., servo-controlled electric motors or air turbines which are affixed to the rear side of front panel 4. The drive units are commonly provided with braking means for stopping rotation of the supply reel shaft and the winding spindle 20. A detailed description and drawings of the foregoing and other parts of the tape splicing and winding machine are omitted for brevity and because they are not essential to comprehension of the construction and function of the present invention.

The splicing head assembly 6 is essentially the same as the splicing head described and illustrated in U.S. Pat. Nos. 3,753,835 and 3,737,358. Essentially the splicing head assembly 6 comprises a stationary splicing block 20 affixed to panel 4 and a moveable splicing block 22. The two blocks have mutually confronting flat vertical end surfaces that are separated by a very narrow gap 24. Although not shown, it is to be understood that stationary block 20 has a horizontally extending upper surface in which is formed a single groove that functions as a guideway for tape 10 and the base of the groove is provided with a series of small apertures which communicate with a source of vacuum through a suitable valve means. Thus if tape 10 (or a leader tape) is placed in the groove and vacuum is applied to splicing block 20, a suction force will be established which will hold the tape tight against the bottom of the groove.

The moveable splicing block 22 is mounted on two slide rods 28 and 30 for movement toward and away from front panel 4. Although not shown, it is to be understood that block 22 has a horizontally extending upper surface that is formed with two parallel grooves which are identical in shape and extend parallel to the groove of fixed splicing block 20, and these grooves also have a series of apertures formed in their bases whereby suction may be applied to tapes positioned in the two grooves. The apertures in the two grooves communicate via separate passageways (not shown) that are connected to a source of vacuum through suitable control valve means (not shown), whereby suction may be selectively applied to hold down magnetic tape located in the inner groove and leader tape disposed in the outer groove.

Suitable operating means (not shown) are provided for moving block 22 in and out relative to panel 4 so as to selectively align either of its two grooves with the groove in block 20. In machines of the type described in U.S. Pat. Nos. 3,753,835 and 3,737,358, the means for moving the moveable splicing block 22 comprises a moveable crossblock disposed behind the panel 4 and attached to the piston rod of a double-action type fluid actuator which is secured to the panel 4 and is connected by means of hoses and an appropriate control valve mechanism to a suitable source of pressurized air. When air is supplied to one end of the actuator, the actuator piston rod is retracted, moving the splicing block 22 up against the panel 4 so as to place its outer groove into alignment with the groove in stationary block 20. When air is applied to the other end of the same actuator, its piston rod is extended so as to move the splicing block 22 outwardly far enough so that inside groove is aligned with the groove in block 20.

The machine also includes a knife mechanism which forms part of the splicing head assembly. The knife mechanism comprises an actuator (not shown) of the double-acting type which is affixed to the rear side of panel 4 and has an elongate cutter blade support arm 34. The support arm 34 extends through an aperture in the panel 4. The free end of support arm 34 is slotted on one side so as to accommodate a cutter blade 36 which is mounted in line with the small gap 24 between the two splicing heads 20 and 22, with its cutting edge facing down and inclined. When the piston rod of its actuator is fully retracted, arm 34 is withdrawn far enough so that the front end of the cutting blade 36 will not interfere with movement of tape along the grooves in blocks 20 and 22. When the piston rod of its actuator is extended, arm 34 moves forward and the cutting edge of knife 36 slices through whatever tape is extending across from the groove in block 20 to one of the grooves in block 22.

The splicing tape dispensing unit 8 is adapted to apply a piece of adhesive-backed splicing tape to the abutting ends of two tapes supported by two splicing blocks. Details of the splicing tape dispensing unit are shown in the drawings. Essentially the unit 8 comprises a carriage plate 140 that is adapted to be attached to an arm 142 that extends through a vertical slot 144 in machine panel 4. Arm 142 forms part of a mechanism (not shown) which is mounted on the rear side of machine panel 4 and is adapted to reciprocate arm 142 vertically in slot 144 on command. Such a mechanism is shown and described in U.S. Pat. No. 3,753,835. It is to be noted, as shown in FIG. 5, that the carriage plate 140 is provided with a pair of cavities on its rear side which are sized to snugly accommodate two pins 143 that are anchored in and project from arm 142. Thus the carriage plate 140 may be detached readily from the arm 142.

Carriage plate 140 is provided with means for rotatably supporting a roll 163 of splicing tape 164 which is coated on one side with a pressure sensitive adhesive. Such means may take various forms and, for example, may comprise a hub 160 having an enlarged flange 162. Hub 160 serves to rotatably support the roll 163 of splicing tape 164. The roll 163 is held in place on hub 160 by suitable means, e.g., a plastic cap 165 which is adapted to slip over and make a friction fit with the hub 160. The coil 163 is positioned on hub 160 so as to be in planar alignment with feed rolls hereinafter described.

Referring now to FIG. 6, plate 140 has a large hole in which is mounted a roller bearing unit 166. The outer race of the bearing unit 166 is locked to plate 140. The inner race of the bearing unit surrounds and is secured to a one-way clutch unit, identified generally by the numeral 168, which preferably is a precision overrunning roller clutch of the type manufactured by the Torrington Company of Torrington, Conn. and described in U.S. Pat. No. 3,753,835. Mounted within the clutch unit is a drive shaft 182. Affixed to the rear end of shaft 182 is a hub 184 having a flange 186. Hub 184 carries a radially extending arm 188. Shaft 182 is restrained against axial movement by (a) engagement of flange 186 with the rear end of clutch housing 170 and the inner race of bearing 166, and (b) engagement of a snap ring 190 with the front end of housing 170. Snap ring 190 is mounted in a peripheral groove formed in shaft 182. The clutch is made so that if (as seen in FIGS. 1 and 6) the shaft 182 is urged clockwise, housing 170 will rotate with shaft 182. On the other hand, if the shaft 182 is urged in a counterclockwise direction, shaft 182 will rotate without causing rotation of the housing 170.

One-way clutches, are well known in the art and are exemplified by U.S. Pat. Nos. 3,482,667, 3,476,226, 2,832,450, 2,912,086, 3,194,369, 3,260,333, 2,569,108, 3,184,020 and 2,569,108. These and other types of one-way clutches known to persons skilled in the art may be used for the same purpose as clutch unit 168.

Surrounding and secured to the clutch housing 170 is a large spur gear 192 and a tape feeding wheel or roll 194. The latter has a circumferential groove 196 that is just wide enough to receive the splicing tape 164, e.g., about 0.003 inch wider than tape 164. Roll 194 is mounted so that its groove 196 is located in planar alignment with the roll 163. Also affixed to carriage plate 140 is a short stub shaft 197. Rotatably mounted on stub shaft 197 are a second smaller spur gear 198 and a second smaller feed wheel or roll 200. The latter is connected to gear 198 so that they can rotate as a unit. A snap ring 202 secured in a groove on shaft 197 holds the feed wheel 200 on the shaft. Gear 198 meshes with gear 192 and the feed wheel 200 has a circumferential groove which is located in complanar relation with groove 196 of feed roll 194 and is stepped in cross-section, comprising groove sections 201 and 203. Groove 201 is narrower than tape 164. Groove 203 is just wide enough to accommodate splicing tape 164, e.g., about 0.003 inch wider than tape 164. Groove section 203 has the same width as groove 196. A tape guide pin 204 is also affixed to carriage plate 140 below feed roll 194. Pin 204 has a peripheral groove as shown at 206 which has the same width as and is in planar alignment with the grooves 196 and 203 in rolls 194 and 200.

Also attached to the carriage plate 140 is a spring latch 208 having a finger 210 which presses against the teeth of gear 192 and prevents rotation of that gear under the influence of shock and vibration when no rotational force is being exerted on drive shaft 182. The finger 210 also prevents counterclockwise rotation of gear 192 and feed roll 194.

Mounted above stub shaft 197 on carriage plate 140 is a small block 212. Attached to block 212 and projecting from its bottom end are two vertically-extending guide pins 214 which lie in a plane extending at a right angle to the plane of plate 140 and are spaced from one another by an amount only slightly greater (e.g. about 0.003 inch more) than the width of splicing tape 164, so that the tape can move between the guide pins while being effectively restricted against moving sidewise. It is to be noted that splicing tape for standard size Phillips audio cassettes has a width of 0.130 inch (plus/minus 0.002 inch). Hence, for a splicing tape dispenser-applicator according to this invention, the gap between pins 214 is preferably about 0.133 inch. Pins 214 terminate near feed roll 200 and are located so that they straddle the tape groove 203 of that roll. Preferably pins 214 are located so that their bottom ends terminate at points close to the 10 o'clock position on roll 200. Also attached to block 212 is a plate 215 carrying a rubber pressure roller 217 which has approximately the same width as splicing tape 164 and is positioned so as to press the tape against the two spaced cylindrical surfaces forming the base of groove 203.

Also mounted to a raised section 218 of plate 140 by a screw 219 is an L-shaped tape picker 216. The latter is located between roll 200 and member 224 hereinafter described and is formed so that its upper end has a flat surface 220. Picker 216 has a thickness slightly less than the width of groove 201 and is positioned so that it extends into that groove and its surface 220 is tangent to the surfaces which form the base of groove 203. The right hand end of surface 220 (as viewed in FIG. 3) is preferably bevelled as shown and terminates at about the 12 o'clock position relative to feed roll 200.

Figure 3:
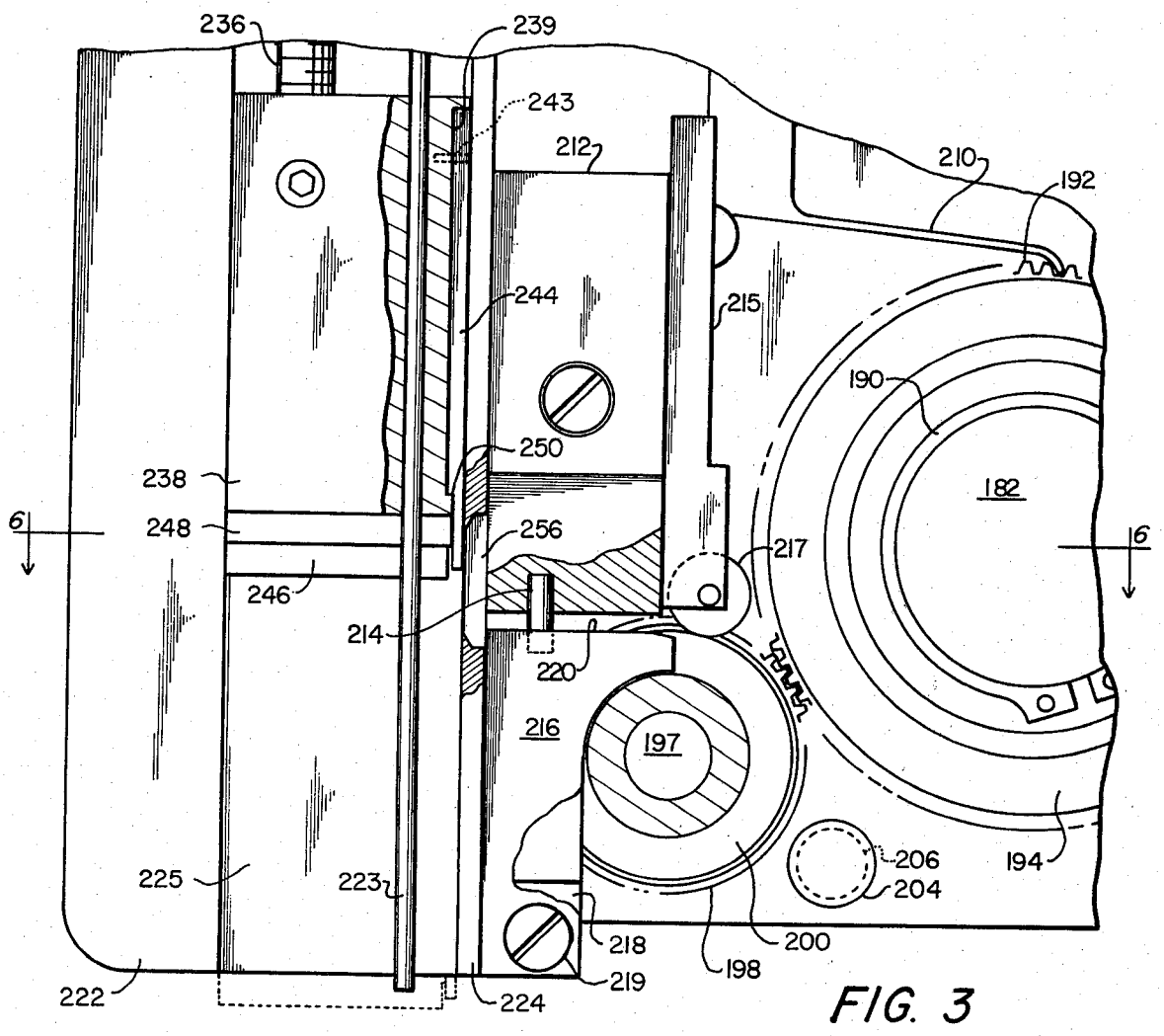
FIG. 3 is a fragmentary front elevational view on an enlarged scale of the splicing tape dispensing mechanism with certain parts shown in section.

Also carried by plate 140 are two vertically extending members 222 and 224 that define a vertical channel 225. These members are spaced from each other and are connected at their top ends by a horizontally extending block 226 which serves as a mounting plate for a double-acting fluid pressure actuator 228 and a pin guide assembly comprising a flat plate 221 and two vertical guide pins 223 which are spaced apart by the same amount as pins 214 so as to allow the tape 164 to move between them while being effectively restricted against sidewise movement. Plate 221 is affixed to plate 226 by any suitable means such as screws (not shown) and each pin 223 is in planar alignment with one of the guide pins 214. The opposite ends of cylinder 230 of actuator 228 are provided with hose fittings 232 (only one of which is shown) for admitting air to the cylinder. The piston rod 236 of actuator 228 extends through aligned oversized holes (not shown) in mounting block 226 and plate 221 down into the channel 225. Attached to the end of piston 236 is a plunger or ram 238. Plunger 238 has two through holes located so as to accommodate pins 223. The holes in plunger 238 are sized so that a sliding fit is provided between the plunger and pins 223. The at-rest position of plunger 238 is as seen in FIG. 1. Pins 223 are made long enough so that they are still mated with the plunger when the latter reaches the end of its downward stroke (the lowermost position of plunger 238 is shown in phantom in FIG. 3). On its downward stroke the plunger moves down far enough to cause the pad 246 hereinafter described to tightly press the severed piece of splicing tape against the tapes to be spliced positioned on splicing blocks 20 and 22. Preferably pins 221 protrude slightly below the bottom ends of members 222 and 224 as shown in FIG. 3.

As seen in FIG. 6, the member 222 is provided with a vertically extending slot 240 sized to slidably and snugly receive a rib 242 formed integral with the plunger 238. Groove 240 cooperates with rib 242 to guide the plunger 240 as it is reciprocated by operation of actuator 228. Groove 240 also serves as a guide for the leading end of tape 164 as described more fully below. To assure proper splicing tape alignment, the slot 240 has a width substantially identical to the gap between pins 214. The plunger 238 has a longitudinally extending slot 239 at the side opposite rib 242 and mounted in this slot by means of a fastener 243 is a cutter blade 244. Cutter blade 244 slidably engages the inner surface of the member 224. The cutter blade 244 and the member 224 are made of high quality tool steel. The bottom end of the plunger 238 is provided with a resilient pad 246 having a width (i.e. its dimension perpendicular to the plane of FIG. 3) which is slightly greater than the width of the splicing tape 164. The pad 246 is attached to a rib 248 formed on the bottom end of the plunger 238. Rib 248 and pad 246 have substantially the same width. To maximize the length of pad 246 and hence the length of that portion of a splice which is subjected to bearing pressure by pad 246, the slot 239 and cutter blade 244 are stepped in depth and thickness respectively as shown at 250. Pad 246 has a thickness such that when the plunger is at the bottom end of its stroke, the pad will project below the bottom ends of pins 223 by an amount sufficient to allow the pad to be pressed tightly against the tapes to be spliced without allowing the pins to contact the splicing blocks.

Figure 4:
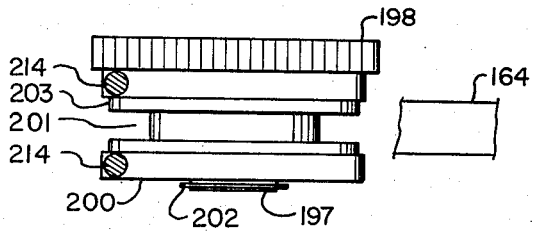
FIG. 4 is a fragmentary plan view illustrating one of the tape feed rolls and the relative positions of adjacent guide pins.

The splicing tape is introduced into channel 225 through a horizontal slit 256 (FIG. 4) formed in the member 224. Thus as shown in FIG. 3, the path followed by the splicing tape is around the feed roll 194, under and around pin 204, up and around feed roll 200 and under the roller 217, over picker 216, between guide pins 214 and through horizontal slit 256 into the channel 225 below the plunger 238. It is to be noted that slot 240 in the member 222, the pad 246 and the rib 248 of plunger 238 are in planar alignment with grooves 196 and 203 of feed rolls 194 and 200, so that as the splicing tape is advanced into the channel 225 beneath the plunger 238, it will pass between pins 223 and can proceed far enough to enter the groove 240.

Figure 7:
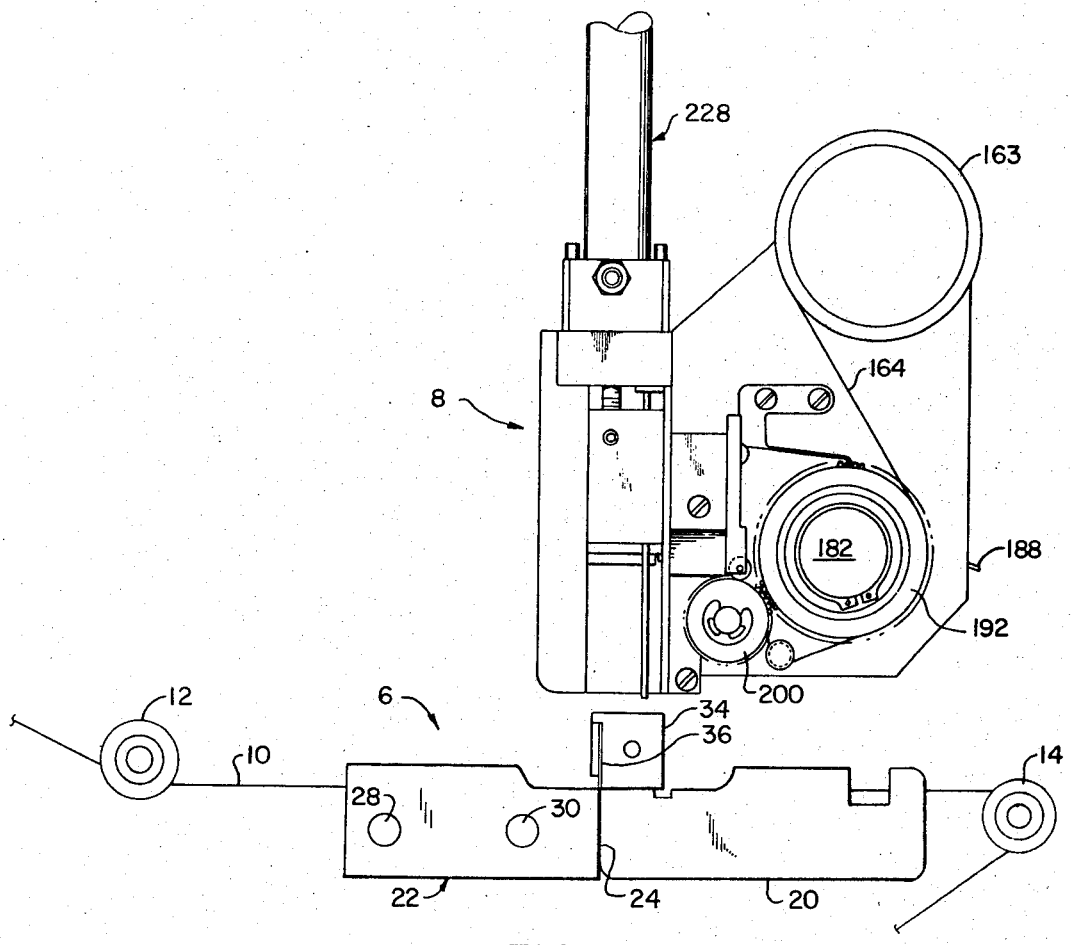
FIG. 7 is an elevational view illustrating the relative positions of the splicing tape dispenser mechanism and the splicing head assembly of a cassette loading machine.

Referring now the FIGS. 5 and 7, it is contemplated that the panel 4 will carry two vertically spaced pins 260 and 262 on its front side. The splicer tape dispenser-applicator 8 is mounted so that the arm 188 carried by hub 184 is disposed between pins 260 and 262. Pins 260 and 262 act to cause arm 188, and thereby shaft 182, to rotate counterclockwise (as seen in FIGS. 1 and 7) when carriage plate 140 is moved downward toward splicing blocks 20 and 22 and clockwise when the plate is moved upward again. Due to the operation of clutch unit 168, feed rolls 194 and 200 rotate to feed tape 164 when the carriage plate moves upward and remain stationary when the carriage plate moves downward. Pins 260 and 262 are spaced by an amount such as to cause arm 188 to rotate the two feed rolls just enough to advance the splicing tape through a distance equal to or slightly less than the distance between the inner face of member 224 and the opposite end face of slot 240.

The mode of operation of the splicing tape dispenser mechanism just described is set forth below with reference to FIG. 7 and operation of a winding machine of the type disclosed in U.S. Pat. No. 3,753,835.

Assume that in the course of winding tape into a cassette the cutter mechanism has completed a cutting operation, the movable splicer block 22 is properly positioned for a tape splicing operation, e.g., the leading end of a magnetic tape to be wound into a cassette is located in its inner groove (the one closest to panel 4) in alignment with a leader positioned in the tape receiving groove of stationary block 20, and the splicing tape dispenser-applicator 8 is in the elevated position shown in FIG. 7. Assume also that the splicing tape 164 has been advanced far enough so that it extends between pins 223 and its leading end engages the surface defining the base of groove 240. The splicing tape 164 makes a close fit in groove 140 and between pins 223, and under such conditions, the free end of the splicing tape will tend to lie flat against and be precisely aligned with pad 246. The first step in the mode of operation is to actuate the mechanism for vertically reciprocating the carriage plate 140 so as to drive the carriage plate 140 of the dispensing mechanism downwardly far enough for the guide pins 223 to nearly engage the splicing blocks 20 and 22. Then with the carriage plate in this down position, the actuator 228 is operated so as to cause its plunger 238 to move downward in channel 225. As the plunger moves downwardly the cutter member 244 severs the splicing tape by a shearing action at the point where the tape comes through the slit 256. The severed portion of splicing tape, kept aligned with pad 246 by groove 240 and guide pins 223 for substantially the full down stroke of the plunger, is driven downwardly by the plunger 238 into tight engagement with the abutting ends of the leader tape in the groove of splicer block 20 and the magnetic tape in the aligned groove of splicer block 22, whereby the pressure-sensitive adhesive coating on the splicing tape causes the splicing tape to be attached to the two tapes. Immediately thereafter actuator 228 is caused to raise plunger 238 back to its original position. The severed splicing tape remains in contact with the spliced tapes on the splicing block as the plunger 238 moves upwardly agains to its original position. As the plunger 238 moves upwardly again, or after it has returned to its original elevated position, the mechanism for reciprocating the carriage plate is actuated so as to cause the carriage plate 140 to move upwardly again to its original raised position. As the carriage plate moves upwardly, the arm 188, which is restrained by pin 260, rotates and thereby causes the shaft 182 to rotate. This rotation of shaft 182 causes the gears 192 and 200 to rotate clockwise and counterclockwise respectively (as seen in FIGS. 1 and 3) so as to advance an additional length of splicing tape into the channel between the members 222 and 224 in anticipation of the next cycle of operation of the splicing tape dispenser as above described.

In the course of loading magnetic tape into a cassette, the splicing tape dispenser-applicator is operated twice in the manner above described so as to apply a section of adhesive-backed splicing tape to the abutting ends of two tapes to be spliced, i.e., first to splice the leading end of a length of magnetic tape to a leader attached to one hub, and second to splice the trailing end of the same length of magnetic tape to a leader attached to the other cassette hub.

It is to be understood that the illustrated device may be modified without departing from the essence of the invention. Thus, for example, if the dispenser-applicator is installed in a machine where the carriage plate is held stationary close to the splicing head, a separate operating mechanism may be coupled to arm 188 by a lever arranged so that shaft 182 is rotated a limited amount each time the operating mechanism is actuated. Still other changes will be obvious to persons skilled in the art.

A splicing tape dispenser-applicator made in accordance with this invention offers a number of advantages over the device disclosed in U.S. Pat. No. 3,753,835. First of all, it does not require vacuum to maintain the severed piece of splicing tape aligned with pressure pad 246 as the plunger drives the splicing tape downward in channel 225 and presses it against the tapes to be spliced resting on splicing blocks 20 and 22. The tape is kept in alignment by the sides of groove 240 and pins 223. Secondly the plunger is less expensive to make since it does not require internal passageways for applying a vacuum to hold the severed splicing tape against pad 246. A third advantage resides in the provision of guide pins 214 to properly guide the splicing tape into channel 225. A fourth advantage is that the guide pins 214 do not interfere with the picker 216, the latter serving to assure that when the splicing tape is being threaded, it will automatically be directed toward slit 256 and not remain in contact with feed roll 200 past its 12 o'clock position. A fourth important advantage is that the length of pressure pad 246 is maximized by making the cutter blade 244 with a stepped configuration. The longer pressure pad 246 improves the quality of the splice since only a small amount, if any, of the severed splicing tape is not engaged and pressed directly by pad 246 against the tape being spliced. The stepped configuration also allows the major portion of the cutter blade to be sufficiently thick to facilitate its attachment to the plunger. Other advantages will be obvious to persons skilled in the art.

What is claimed is:

1. A splicing tape-dispensing mechanism comprising a support plate, means carried by said plate for feeding an elongate splicing tape, tape feed operating means for operating said tape feed means so that a predetermined amount of tape is advanced by said tape feeding means each time said tape feeding means is operated, guide means carried by said plate for positioning the leading end of said tape as it is advanced by said tape feeding means, reciprocating cutting means carried by said plate for severing a length of said tape including the leading end thereof at a selected point relative to said guide means, reciprocating dispensing means carried by said carriage plate for dispensing the said length of tape severed by said cutting means, and means carried by said plate defining a guide channel, said cutting means and said dispensing means being disposed within and moveable longitudinally of said guide channel, said channel having a side opening whereby tape advanced by said tape feeding means enters said channel in position to be severed by said cutting means, said channel also being open at one end to permit tape severed by said cutting means to be dispensed by said dispensing means, the improvement comprising an additional stationary tapeguide means extending lengthwise of said channel for maintaining said severed length of tape aligned with said dispensing means.

2. A mechanism according to claim 1 wherein said reciprocating dispensing means is a ram and said stationary tape guide means comprises a pair of parallel pins arranged so as to maintain said severed length of tape aligned with said ram.

3. A mechanism according to claim 2 wherein said cutting means comprises a cutter blade attached to said ram.

4. A mechanism according to claim 3 wherein said ram has a bottom surface and two side surfaces extending at a right angle to said bottom surface, said cutter blade has a relatively thick section and a relatively thin section, and one of said side surfaces is relieved to accommodate said relatively thick section.

5. A mechanism according to claim 4 further including a resilient pressure pad attached to the bottom surface of said ram, said relatively thin section of said cutter blade extending along side of said pressure pad.

6. A mechanism according to claim 5 wherein said first-mentioned guide means comprises a pair of mutually spaced guide members located between said channel side opening and said tape feeding means.

7. A mechanism according to claim 1 wherein said dispensing means is a ram and said cutter means is a blade attached to one side of said ram, and further wherein said additional stationary guide means comprises two parallel pins.

8. A mechanism according to claim 7 wherein said parallel pins are located within said channel.

9. A mechanism according to claim 8 wherein said ram has two longitudinally extending holes and said pins extend through said holes.

10. A mechanism according to claim 9 wherein said pins protrude from said open end of said channel.

11. A mechanism according to claim 7 wherein said channel is defined by two parallel plates and an end plate, and said parallel pins are attached to said end plate.

12. A mechanism according to claim 7 wherein said dispensing means includes a resilient pressure pad attached to the end of said ram, and said cutter extends along side of said pad.

13. A mechanism according to claim 7 wherein said tape feeding means comprises first and second tape feed spools, and said tape feed operating means comprises gear means connecting said tape feed spools so that said second spool will rotate in synchronism with said first spool.

14. A mechanism according to claim 13 wherein said tape feed operating means includes a one-way rotary clutch and a shaft coupled by said clutch to said means for feeding splicing tape, and means for rotating said shaft so as to cause said clutch to operate said tape feeding means.

15. In a splicing tape applicator comprising a carriage, means mounting said carriage for reciprocal movement along a straight-line path, a shaft, a clutch rotatably supported by said carriage and coupled to said shaft, said clutch being adapted to permit relative rotation of said shaft when said shaft is subjected to a turning force in one direction and to lock to said shaft when said shaft is subjected to a turning force in the opposite direction, means for feeding splicing tape including a tape feed spool and means coupling said tape feed spool to said clutch so that said tape feed spool and clutch will rotate as a unit, tape guide means carried by said carriage for guiding the leading end of splicing tape advanced by said tape feed spool, tape cutting and applying means associated with said guide means comprising a knife for cutting a length of tape off of the leading end of said splicing tape at a point within said guide means and a pressure member for dispensing said length of tape and applying it under pressure to materials to be spliced, means for rotating said shaft first in said one direction and then in said other direction as said carriage is reciprocated, and means for actuating said tape cutting and applying means, the improvement comprising a pair of stationary guide pins for maintaining said length of tape aligned with said pressure member.

16. A splicing tape applicator according to claim 15 wherein said pressure member includes a pressure pad.

17. In a machine for splicing magnetic tape to a leader and winding said leader and magnetic tape on a spool, said machine including a splicing head with horizontally extending surfaces for supporting magnetic and leader tapes to be spliced, an improved splicing tape applicator for applying a length of adhesive-coated splicing tape to the said tapes to be spliced, said applicator comprising a carriage disposed above said splicing head, means supporting said carriage for reciprocal straight line movement toward and away from said splicing head, means carried by said carriage for feeding splicing tape, means for operating said splicing tape feeding means only when said carriage is moving away from said splicing head, guide means carried by said carriage for positioning the leading end of said splicing tape as it is being advanced by said feeding means so that it is aligned longitudinally with said splicing head surfaces, selectively operable means for (a) severing a length of splicing tape off of said leading end thereof, (b) propelling said severed length of tape downwardly toward said splicing head and (c) pressing said severed length of tape down onto the ends of magnetic and leader tapes supported by said splicing head surfaces, and means for operating said selectively operable means, said selectively operable means comprising a reciprocable plunger for propelling and pressing said severed length of tape and stationary guide means carried by said carriage for maintaining said severed length of tape aligned with said plunger as said plunger is reciprocated so as to apply said severed length of splicing tape to the said tapes to be spliced.

* * * * *